United States Patent [19]

Kato et al.

[11] 4,254,204

[45] Mar. 3, 1981

[54] MAGNETIC BRUSH ELECTROGRAPHIC DEVELOPING METHOD

[75] Inventors: Hitoshi Kato; Koji Nagai; Hiromi Kameda, all of Itami, Japan

[73] Assignee: Minolta Camera Kabushiki Kaisha, Japan

[21] Appl. No.: 6,451

[22] Filed: Jan. 24, 1979

[30] Foreign Application Priority Data

Feb. 24, 1978 [JP] Japan ..... 53-21386

[51] Int. Cl.[3] ..... G03G 13/09

[52] U.S. Cl. ..... 430/122; 430/107; 430/111

[58] Field of Search ..... 252/62.1 R, 62.1 P; 427/18; 96/1 SD; 430/107, 109, 110, 111, 122

[56] References Cited

U.S. PATENT DOCUMENTS

| | | | |
|---|---|---|---|
| 3,345,294 | 10/1967 | Cooper | 96/1 SD X |
| 3,645,770 | 2/1972 | Flint | 427/18 |
| 4,082,681 | 4/1978 | Takayama et al. | 252/62.1 P |
| 4,108,786 | 8/1978 | Takayama et al. | 252/62.1 P |
| 4,111,823 | 9/1978 | Kobayashi et al. | 427/18 X |
| 4,137,188 | 1/1979 | Uetake et al. | 252/62.1 P |
| 4,155,883 | 5/1979 | Oguchi et al. | 430/107 |

*Primary Examiner*—Roland E. Martin, Jr.
*Attorney, Agent, or Firm*—Wenderoth, Lind & Ponack

[57] ABSTRACT

An electrographic developing method for developing a latent electrostatic image on a support to a toner image by brushing the image bearing surface of the support with a magnetic brush comprising a magnetic toner which comprises core particles having a low resistivity and containing a resin and a finely divided magnetic material, and secondary particles thermally adhered to part of the outer surface of each core particle and said secondary particles consisting predominantly of an insulating resin.

18 Claims, 4 Drawing Figures

MAGNETIC BRUSH ELECTROGRAPHIC DEVELOPING METHOD

BACKGROUND OF THE INVENTION

This invention relates to an electrographic developing method, and more particularly to a method of developing latent electrostatic images to toner images with a magnetic brush comprising a magnetic toner.

Latent electrostatic images formed on the surface of a support (such as electrostatic recording paper in facsimile or a photoconductive member in electrophotographic copiers) can be developed to visible images advantageously, for example, by the method disclosed in U.S. Pat. No. 3,909,258 in which the image bearing surface is brushed with a magnetic brush of low-resistivity magnetic toner particles prepared from a dispersion of fine magnetic particles in a resin and having carbon black or a like electroconductive material embedded in the surfaces of the toner particles.

Because of various advantages, this method has found wide application in electrophotographic copies, etc. However, the copiers in which this method is used have been limited solely to those of the Fax type in which the copy paper itself is developed. In fact, the method still remains to be improved for use in so-called plain paper copiers (PPC) which appear to be ideal copying machines.

Presumably this is due to the fact that whereas the magnetic toner used for this method must be highly amenable to the injection of charges and therefore have a low resistivity, extreme difficulty is encountered in transferring such a toner of low resistivity from the image bearing surface to the copy paper. Stated more specifically, when latent images developed with the low-resistivity toner, namely toner images, are to be transferred from the support to paper by corona charging with the use of the usual transfer unit, the toner image becomes markedly broken during the transfer operation, thus affording a copy which is no longer suited for use. The break in the toner image appears attributable to the phenomenon that when the toner is exposed to corona charges, toner particles are transferred to an area of the paper other than the image area to be formed thereon, or some toner particles are scattered due to a change in polarity.

Various attempts have been made to give the magnetic toner the highest possible resistivity and to thereby eliminate the problem involved in the transfer of the magnetic toner by a corona discharge unit, but the remedy, although achieved to some extent, adversely affects the development of the latent image, thus failing to provide useful toner images.

Additionally the method disclosed in U.S. Pat. No. 3,909,258 has another drawback in that it is low in the reproducibility of gradation when used in a PPC for developing latent electrostatic images having a high potential of up to about 500 to about 1000 V, even if the copies obtained are usable.

This will be described below in detail with reference to FIG. 1, which shows the relationship between the potential of latent electrostatic images and the amount of magnetic toner deposited on the image bearing surface when the latent image is developed by the method of the above-mentioned U.S. patent. The potential P is plotted as the abscissa vs. the amount T as the ordinate. The solid line A in FIG. 1 represents the above relationship as established by the use of a magnetic toner having a low resistivity of $10^8$ ohm-cm (commercial magnetic toner presently available for use in Fax-type copiers). The dot-and-dash line B shows the relationship as determined by the use of a magnetic toner having a high resistivity of 10— ohm-cm. The solid line A indicates that when the potential of the latent image is in the range of 0 to 500 V, the potential is approximately proportional to the amount of deposited toner, permitting satisfactory reproduction of gradation within the range, whereas at potentials above 500 V, the amount of toner remains substantially constant irrespective of the potential, failing to reproduce the gradation. The dot-and-dash line B reveals that latent images, if having a potential of about 1000 V, can be developed only to a low overall density with a lesser amount of toner deposition.

SUMMARY OF THE INVENTION

The main object of this invention is to provide a novel and very useful electrographic developing method.

Another object of this invention is to provide an electrographic developing method free of the problems encountered with the conventional electrographic developing method described above in which a low-resistivity magnetic toner is used.

Another object of this invention is to provide an electrographic developing method which is outstanding in gradation reproducibility.

Another object of this invention is to provide an electrographic developing method employing a novel magnetic toner with which latent electrostatic images can be satisfactorily transferred from an image bearing member to copy paper by corona charging with the use of a corona discharge unit.

Still another object of this invention is to provide an electrographic developing method as described above which is suited for PPC.

These and other objects of this invention can be fulfilled by an electrographic developing method for developing a latent electrostatic image on a support to a toner image by brushing the image bearing surface of the support with a magnetic brush comprising magnetic toner which comprises core particles having a low resistivity and containing a resin and fine particles of a magnetic material, and secondary particles thermally adhered to part of the outer surface of each core particle and consisting predominantly of an insulating resin.

These and other objects, advantages and features of the invention will become apparent from the following description thereof when read in conjunction with the accompanying drawings which illustrate exemplary embodiments of the invention.

BRIEF DESCRIPTION OF THE DRAWINGS

In the following description, like parts are designated by like reference numbers throughout the several diagrams of the attached drawings.

DETAILED DESCRIPTION OF THE INVENTION

Figure 3:
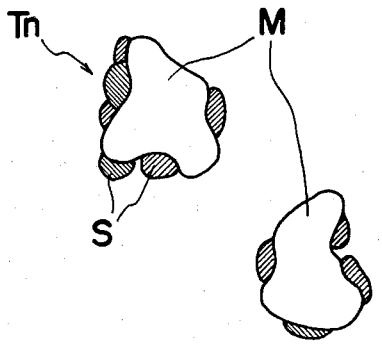
FIG. 3 is an enlarged view in section showing magnetic toner particles useful for the method of this invention.

The magnetic toner to be used in the electrographic developing method of the invention is produced by mixing together low-resistivity core particles prepared from a dispersion of fine particles of a magnetic material in a resin and secondary particles consisting predominantly of an insulating resin, and subjecting the resulting mixture to heat treatment to thermally adhere the secondary particles to the core particles. FIG. 3 specifically shows the configuration of magnetic toner particles Tn comprising a core particle M and secondary particles S thermally adhered to the surface of the core particle M. It is seen that secondary particles S are concentrically adhered to recessed and projecting portions of the core particles M. This is presumably because the secondary particles S are so adhered to the core particle M when the two kinds of particles are mixed together during the production process. It appears that when the secondary particles S are brought into frictional contact with the core particles M, some particles S are triboelectrically attracted to the projections of the particles M, while other particles S are brought to the recesses of the particles M for concentric adhesion to these portions.

The core particles M have a resistivity of up to $10^{12}$ ohm-cm, preferably up to $10^{10}$ ohm-cm. The resistivity of the core particles M is controllable by using an electroconductive magnetic material as the finely divided magnetic material, or by incorporating a conductivity imparting agent into the resin component of the particles M. The resin and magnetic material for the core particles M can be selected from among those generally used for developers. A coloring agent can be incorporated into the core particles M when so desired.

The secondary particles S, when brought into frictional contact with the core particles M, can be triboelectrified to a polarity suitable for development, namely to a polarity opposite to the polarity of the latent image, while having such insulating properties as to retain the triboelectrical charges. The insulating resin for the secondary particles S can be selected from among those generally used for developers as desired. The secondary particles S, like the core particles M, may incorporate a desired coloring agent.

The ratio of the coverage by the secondary particle S over the surface of the core particle M is preferably in the range of about 10 to about 50% although determinable optimally in accordance with the sizes of the two kinds of the particles. This ratio is not directly indicative of the ratio of the cover afforded by the particles S relative to the entire surface of the core particle M but indicates the ratio of the surface area of the particles S which can substantially contact other toner particles on the surface area of their core particles M.

The insulating resin serving as the main component of the secondary particles for the production of the magnetic toner according to this invention differs from the resin component of the core particles in melting point, whereby the secondary particles can be easily adhered to the outer surfaces of the core particles merely by simple heat treatment. However, the heat treatment in this case must be conducted at a temperature lower than the melting point of the high-melting resin.

The secondary particles, when having a relatively large size not exceeding the size of the core particles, give the toner improved fixing properties.

The magnetic toner useful for the method of this invention has the following physical properties (1) and (2) because of the foregoing structure.

(1) When toner particles come into frictional contact with one another by being subjected to some physical force, as when forming a magnetic brush, the core particles triboelectrically acquire charges of one polarity and the secondary particles acquire charges of the opposite polarity. At this time, the core particles are triboelectrified to the same polarity as the latent image, but the charges will dissipate rapidly because the core particles have a low resistivity. On the other hand, the secondary particles acquire charges of polarity opposite to that of the image. Unlike the charges on the core particles, these charges will not rapidly dissipate.

(2) When the toner is formed into a magnetic brush, the brush has, in the direction of the brushing, a resistivity approximating the resistivity of the core particles per se, with the result that charges become easily movable by way of the toner particles in that direction.

Figure 4:
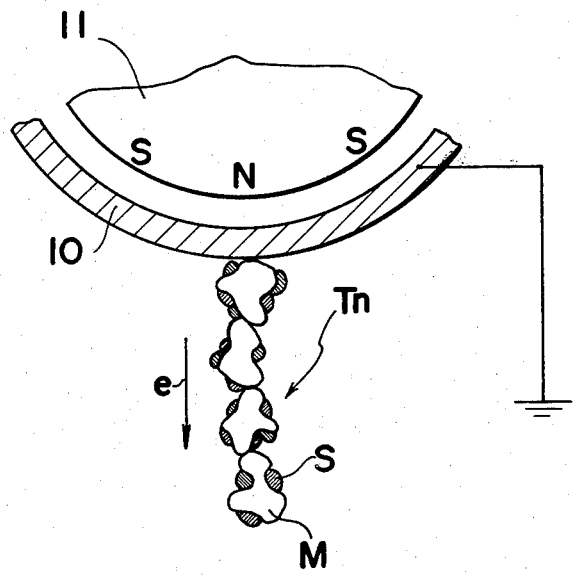
FIG. 4 is a diagram showing, for illustrative purposes, the behavior of particles of the magnetic toner during development.

The physical properties (2) given above will be described below in greater detail with reference to FIG. 4 showing a conductive developing sleeve 10 housing a multipolar magnetic roller 11. When a magnetic brush is formed from the magnetic toner Tn, the toner particles are in contact with one another mainly at surface portions of the core particles, the core particles M thus substantially forming an electrical path in the direction e of the brush. Despite the presence of the insulating secondary particles S, therefore, the brush has in the direction e a resistivity close to the resistivity of the core particles M per se, mainly because the core particles M become individually magnetized, acting to directly contact one another. Moreover, the secondary particles S filling the recesses of the core particles M will facilitate such direct contact.

Since the electrographic developing method of this invention uses a magnetic toner having the novel construction and unique physical properties described above, the method produces the outstanding effects (1) and (2) given below and fulfills the foregoing objects of this invention.

(1) When developing a latent electrostatic image, secondary particles have a triboelectric charge and core particles have a charge injected thereinto through the magnetic brush. The magnetic toner is therefore electrostatically attracted to the latent image by a coulombic force acting between both charges and the latent image. Thus even high-potential latent images can be developed with high gradation reproducibility as indicated in the broken line C in FIG. 1. The results represented by the line C were obtained in Experiment 1 given later.

(2) When the magnetic toner is to be transferred to copy paper by a corona discharge unit, the toner is electrostatically attracted to the surface of the paper by a coulombic force acting between the triboelectric charge of secondary particles and the charge given to the paper by the discharge unit, so that like conventional insulating toners, the magnetic toner can be satisfactorily transferred to the paper, forming a toner image free of any break.

For the description of experiments concerning the method of this invention, the apparatus used in the experiments will be described first with reference to FIG. 2. The apparatus is a PPC.

Figure 2:
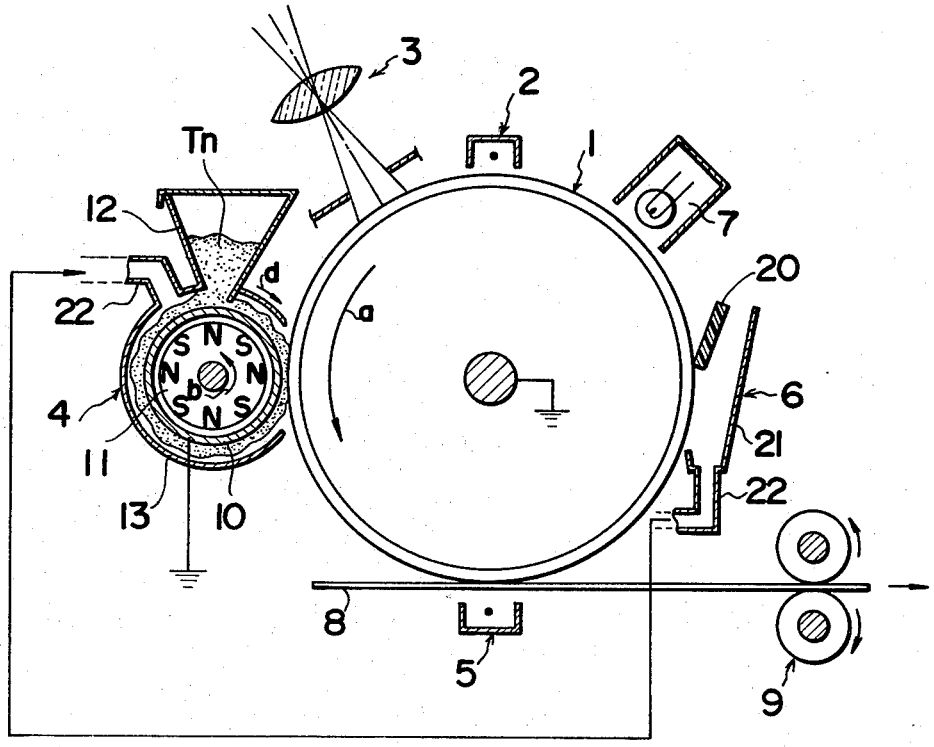
FIG. 2 is a diagram showing a PPC adapted for the electrographic developing method of this invention.

FIG. 2 shows an electrophotographic photoconductive member 1 prepared by depositing a photoconductive material of Se on the outer surface of a drum by vacuum evaporation. The member 1 is driven in the direction of an arrow a in the diagram. Disposed around the member 1 are a corona discharge unit 2 for charging, an original image projecting system 3, a developing unit 4, a corona discharge unit 5 for image transfer, a residual toner removing unit 6 and an eraser lamp 7 which are arranged in the order mentioned. Copy paper 8 is sent out from a feeder (not shown) on the left side of the diagram, passed through the transfer station and fed to a fixing unit 9 comprising a pair of heated rollers. After a toner image corresponding to the image of an original has been formed on the paper, the paper is eventually sent out from the apparatus through an unillustrated outlet.

The developing unit 4 comprises a fixed conductive developing sleeve 10, a magnetic roller 11 rotatable in the direction of the arrow b to feed the magnetic toner Tn in the direction of an arrow d, a toner containing hopper 12 for feeding the toner Tn to the surface of the sleeve, and a housing 13 surrounding the sleeve 10. The gap between the surface of the photoconductive member 1 and the surface of the sleeve 10 is 0.7 mm. The magnetic roller 11 is set for rotation at 700 r.p.m.

The residual toner removing unit 6 is of the type including a blade 20 in sliding contact with the surface of the member 1 for scraping the residual toner off the photoconductive surface. The toner removing unit 6 further includes means for returning the removed toner to the housing 13 through a pipe 22 at the bottom of the housing 21 of the unit for the reuse of the recovered toner for development.

With the PPC apparatus described above, the photoconductive member 1 is uniformly charged by the corona discharge unit 2 and then exposed to an optical image corresponding to the original image and projected thereon by the system 3, whereby a latent electrostatic image is formed on the photoconductive surface. The potential of the latent image ranges from the lowest of about +150 V to the highest of about +750 V. The latent image is developed to a toner image by the unit 4. For development, the sleeve 10 has a bias voltage of the same polarity as the latent image, namely positive polarity. The developed latent image, i.e. toner image, is transferred onto the paper 8 by the corona discharge unit 5 and is thereafter fixed to the paper 8 by the unit 9. The toner remaining on the member 1 is scraped off by the blade 20 and returned to the interior of the developing unit 4 via the pipe 22, while the residual charges on the member 1 are dissipated by exposure to the light from the eraser lamp 7. The charges given by the transfer corona discharge unit 5 have the same polarity as the latent image. Toner particles Tn are brought into frictional contact with one another by being conveyed on the developing sleeve 10 in the direction of the arrow d, whereby the core particles and secondary particles are triboelectrified to a polarity opposite to each other.

We carried out the following experiments with the above apparatus to substantiate the effects of the present method.

EXPERIMENT 1 (Example of the Invention)

EPIKOTE 1002: 100 parts by weight (m.p. 82° C., epoxy resin, tradename of and manufactured by Shell Chemical Co., U.S.A.)

Iron oxide RB-BL: 280 parts by weight (finely divided magnetic material, tradename of and manufactured by Chitan Kogyo Co., Ltd., Japan)

KETJEN BLACK: 10 parts by weight (coloring agent, tradename of and manufactured by the Lion Fat and Oil Co., Ltd., Japan)

These three components were mixed together, kneaded with hot rolls, pulverized and screened to prepare particles 10 to 25 μm in size (hereinafter referred to as "particles A"). These particles were found to have a volume resistivity of $10^{10}$ ohm-cm, which was measured by forming the particles into a magnetic brush and subjecting the brush to an electrical field of about 300 to about 500 V/mm.

On the other hand, the following components were mixed together, kneaded with hot rolls, pulverized and screened to prepare particles 3 to 10 μm in size (referred to as "particles B" below).

PICCOLASTIC D125: 10 parts by weight (m.p. 125° C., styrene resin, tradename of and manufactured by Esso Standard Co., U.S.A.)

KETJEN BLACK: 8 parts by weight

Particles A and particles B were mixed together with stirring in the ratio by weight of 2:1 and then heat-treated at 90° C. to thermally adhere the particles B to the surfaces of the particles A and to obtain a magnetic toner useful for the method of this invention. The particles A were used as core particles, and the particles B as secondary particles.

Figure 1:
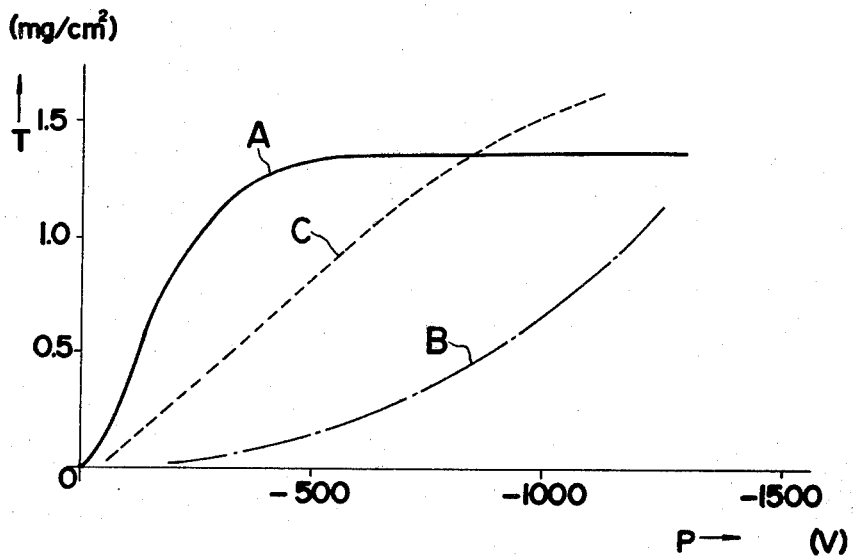
FIG. 1 is a graph showing, for illustrative purposes, the relationship between the potential of latent electrostatic images, P, and the amount of toner, T, deposited on the images as established according to the electrographic developing methods of the prior art and of the present invention.

The toner was tested for copying operation with the use of the apparatus shown in FIG. 2, giving distinct toner images with outstanding gradation reproducibility. Stated more specifically, the toner images were transferred satisfactorily, free of any break whatever. In FIG. 1, the broken line C represents the relationship between the potential of latent images and the amount of toner deposition on the latent images over the photoconductive surface as determined by this experiment.

EXPERIMENT 2

The magnetic toner used in Experiment 1 was tested for the amount of charges by the blow-off method to confirm that the toner can be triboelectrified and is capable of retaining the charges. The test was conducted after mixing the toner with iron carrier granules for 30 minutes, giving a charge amount of 10 μc/g which is comparable to that of a conventional insulating toner. For reference, a magnetic toner having a low resistivity of $10^8$ ohm-cm (commercial magnetic toner now available for use in Fax-type copiers), when similarly tested, was found to have a charge amount as small as about 1 to about 3 μc/g.

EXPERIMENT 3 (Example of the Invention)

HYMER-ST75: 100 parts by weight (m.p. 75° C., styrene resin, tradename and manufactured by Sanyo Chemical Industries, Ltd., Japan)

Iron oxide RB-BL: 280 parts by weight

KETJEN BLACK: 8 parts by weight

Particles 10 to 25 μm in size (referred to as "particles C") were prepared from the above three components in the same manner as in Experiment 1. The particles were found to have a volume resistivity of $10^9$ ohm-cm.

On the other hand, particles 10 to 25 μm in size (hereinafter referred to as "particles D") were prepared from the three components given below in the same manner as in Experiment 1.

HYMER-SBM 73: 100 parts by weight (m.p. 120° C., styrene-acrylic resin, tradename of and manufactured by Sanyo Chemical Industries, Ltd., Japan)

KETJEN BLACK: 4 parts by weight

OIL BLACK: 2 parts by weight (coloring agent, tradename of an manufactured by Orient Chemical Industries, Ltd., Japan)

Particles C and particles D were mixed together with stirring in the ratio of 2:1 by weight and then heat-treated at 100° C. to thermally adhere the particles D to the surfaces of the particles C and obtain a magnetic toner useful for the method of the invention. The particles C were used as core particles, and the particles D as secondary particles.

The toner was tested for copying operation by the apparatus of FIG. 2 with some changes made thereto. The operation give sharp toner images with outstanding gradation reproducibility as is the case with Experiment 1. The above-mentioned changes are a change in the photoconductive member 1 with the use of a photoconductive coating of finely divided CdS and $CdCO_3$ bonded with a resin and the change to negative polarity of the charges given by the charging corona discharge unit 2 and the transfer corona discharge unit 5. Accordingly the latent images in this experiment had a polarity opposite to the polarity of those in Experiment 1, and in this connection the particles C and D were made from such materials that they would be triboelectrified in an opposite relationship to the triboelectrification of the particles A and B.

EXPERIMENT 4(Comparison Example)

A copying test was conducted in the same manner as in Experiment 1 except that the magnetic toner used in Experiment 1 was replaced by a mere mixture of particles A and particles B in the ratio of 2:1 by weight. Particles B scattered around the developing unit 4, while the toner images obtained were found to have been seriously fogged.

EXPERIMENT 5 (Example of the Invention)

The same particles A and particles B as used in Experiment 1 were mixed together with stirring in the ratio by weight of 95:5 and heat-treated at 80° C. to thermally adhere the particles B to the surfaces of the particles A and obtain a magnetic toner useful for the present method. Microscopic observation of the toner revealed that particles A had been covered with particles B in the ratio of about 10%.

The toner was tested for copying operation in the same manner as in Experiment 1 with the same results as achieved in Experiment 1 except that the toner images obtained had a slightly hard tone.

The heat treatment temperature for the production of the toner in this experiment was 80° C., namely 10° C. lower than in Experiment 1 since the particles A were used in a higher proportion than in Experiment 1.

EXPERIMENT 6 (Comparison Example)

PICCOLASTIC D125: 100 parts by weight
KETJEN BLACK: 8 parts by weight
Ligroin: 1000 parts by weight The above components were mixed together and treated in a ball mill for 24 hours to prepare a dispersion, in which particles A (see Experiment 1) were dispersed in 19 times the combined amount of PICCOLASTIC D125 and KETJEN BLACK by weight. The resulting dispersion was spray-dried. The particles obtained were screened to prepare a magnetic toner 10 to 25 μm in particle size. The toner had a volume resistivity of at least $10^{-}$ohm-cm. When the toner was microscopically observed, particles A were found to have been uniformly covered almost over their entire surface.

When the toner was tested for copying operation in the same manner as in Experiment 1, the resulting toner images were found to have marked irregularities in density, while cohesion of toner particles occurred on the developing sleeve 10.

Although the present invention has been fully described by way of example with reference to the attached drawings, it should be noted that various changes and modifications are apparent to those skilled in the art. Therefore, unless otherwise such changes and modifications depart from the scope of the present invention, they should be construed as included therein.

For example, latent electrostatic images on the image bearing surface may be developed by brushing the surface with a magnetic brush of a mixture prepared by admixing an additive, such as an insulating toner, with a magnetic toner as disclosed in Experiments 1, 3 or 5. This method is included in the scope of the invention.

What is claimed is:

1. A magnetic brush electrophotographic developing method for developing an electrostatic latent image which comprises:

frictionally contacting a magnetic toner which comprises core particles having a low resistivity and containing a resin and a finely divided magnetic material, and secondary particles thermally adhered to a part of the outer surface of each core particle and consisting predominantly of an insulating resin:

said secondary particles being triboelectrically charged to a polarity opposite the polarity of the core particles and the latent image when said secondary particles are brought into frictional contact with said core particles, the part of the outer surface of said core particles exposed through the secondary particles being sufficient to permit said core particles to substantially contact each other under the influence of a magnetic field, thereby forming a magnetic brush, said part of said outer surface of said core particles exposed through said secondary particles also being sufficient to permit the core particles to triboelectrically contact the secondary particles which are thermally adhered to the other core particles, said core particles having a low resistivity so as to rapidly dissipate triboelectrical charges;

said secondary particles having a high resistivity so as to retain the triboelectrical charges and developing a latent electrostatic image bearing surface on a support by contacting said surface with said magnetic brush.

2. An electrophotographic developing method according to claim 1, wherein the insulating resin of the secondary particles differs from the resin of the core particles in melting point.

3. The electrophotographic developing method according to claim 1 wherein the melting point of the resin of the secondary particles is higher than that of the core particles.

4. The electrophotographic developing method according to claim 1 wherein the resisitivity of the core particles is lower than $10^{12}$ ohm-cm.

5. The electrophotographic developing method according to claim 1 wherein the resisitivity of the core particles is lower than $10^{10}$ ohm-cm.

6. The electrophotographic developing method as claimed in claim 1 wherein the size of the secondary particles does not exceed the size of the core particles.

7. The electrophotographic developing method according to claim 1 wherein the particle size of the core particles is 10 to 25 μm and that of the secondary particles is 10 to b 25 μm.

8. The electrophotographic developing method according to claim 1 wherein the particle size of the core particles is 10–25 μm and that of the secondary particles is 3–10 μm.

9. The method according to claim 1 wherein the resin for said core particles is an epoxy resin having a melting point of 82° C., the finely divided magnetic material is iron oxide and said core particles are 10–25 μm in size and have a volume resistivity of $10^{10}$ ohm-cm, said secondary particles being formed of a styrene resin having a melting point of 125° C. and having a particle size of 3–10 μm, the ratio of said core particles to said secondary particles being 2:1.

10. A magnetic brush electrophotographic developing method for developing a latent electrostatic image which comprises:

frictionally contacting a magnetic toner which comprises core particles having low resistivity and containing a resin and a finely divided magnetic material, and secondary particles thermally adhered to a portion of the outer surface of each core particle and consisting predominantly of an insulating resin;

said secondary particles being triboelectrically charged to a polarity opposite the polarity of the core particles and the latent image when said secondary particles are brought into frictional contact with said core particles, the degree of coverage by said secondary particles of the surface of said core particles being in the range of 10–50%:

said core particles having a low resistivity so as to dissipate the triboelectrical charges;

said secondary particles having a high resistivity so as to retain the triboelectrical charges, and then forming a magnetic brush comprising said magnetic toner and developing a latent image bearing surface on a support by contacting said surface with said magnetic brush.

11. An electrophotographic developing method according to claim 10 wherein the insulating resin of the secondary particles differs from the resin of the core particles in melting point.

12. The electrophotographic developing method according to claim 11 wherein the melting point of the resin of the secondary particles is higher than that of the core particles.

13. The electrophotographic developing method according to claim 10 wherein the resistivity of the core particles is lower than $10^{12}$ ohm-cm.

14. The electrophotographic developing method according to claim 10 wherein the resistivity of the core particles is lower than $10^{10}$ ohm-cm.

15. The electrophotographic developing method as claimed in claim 10 wherein the size of the secondary particles does not exceed the size of the core particles.

16. The electrophotographic developing method according to claim 15 wherein the particle size of the core particles is 10 to 25 μm and that of the secondary particles is 10 to 25 μm.

17. The electrophotographic developing method according to claim 16 wherein the particle size of the core particles is 10–25 μm and that of the secondary particles is 3–10 μm.

18. The method according to claim 10 wherein the resin for said core particles is an epoxy resin having a melting point of 82° C., the finely divided magnetic material is iron oxide and said core particles are 10–25 μm in size and have a volume resistivity of $10^{10}$ ohm-cm, said secondary particles being formed of a styrene resin having a melting point of 125° C. and having a particle size of 3–10 μm, the ratio of said core particles to said secondary particles being 2:1.

* * * * *